US005430630A

United States Patent [19]

Swarens et al.

[11] Patent Number: 5,430,630

[45] Date of Patent: Jul. 4, 1995

[54] LIGHT BEAM CONVERTER AND DEFLECTOR

[75] Inventors: Ralph W. Swarens, La Verne; Anatoly Kudishevich, Van Nuys, both of Calif.

[73] Assignee: Engineered Lighting Products, El Monte, Calif.

[21] Appl. No.: 199,954

[22] Filed: Feb. 22, 1994

[51] Int. Cl.[6] ..... F21V 7/00; F21V 17/00

[52] U.S. Cl. ..... 362/282; 362/297; 362/306; 362/319; 362/349; 362/451

[58] Field of Search ..... 362/296, 297, 306, 347, 362/348, 349, 319, 277, 282, 433, 449, 451, 346, 17, 18; 248/130, 289.1, 466, 479, 495, 323

[56] References Cited

U.S. PATENT DOCUMENTS

| | | | |
|---|---|---|---|
| 36,339 | 9/1862 | Colburn . | |
| 51,344 | 12/1865 | Oeding . | |
| 196,765 | 11/1877 | Prall . | |
| 529,105 | 11/1894 | Bliss . | |
| 923,655 | 6/1909 | Hough et al. . | |
| 1,799,899 | 4/1930 | Heile . | |
| 4,388,678 | 6/1983 | Turner | 362/296 |
| 4,455,557 | 6/1984 | Thomas | 29/600 |
| 4,933,822 | 6/1990 | Nakamoto | 362/282 |

FOREIGN PATENT DOCUMENTS

| | | | |
|---|---|---|---|
| 23071 | 12/1904 | United Kingdom | 362/319 |

*Primary Examiner*—Ira S. Lazarus
*Assistant Examiner*—Sara Sachie Raab
*Attorney, Agent, or Firm*—J. E. McTaggart

[57] ABSTRACT

For recessed lighting fixtures, particularly those mounted in ceilings, the present invention provides an easily attached removable accessory device for deflecting a portion of the light path in a selected direction that differs from the original direction, e.g. deflecting downwardly directed light to a substantially horizontal direction. A mirror assembly, typically having two round flat reflecting surfaces, one on each side, is supported by a wire hanger element via an axle portion passing diametrically through the mirror; the hanger element has a pair of hooks at the upper ends of two side wires that engage the recessed light fixture at any desired orientation around the axis of the fixture. The mirror can be tilted to any angle, and is retained at the selected tilt angle by friction of the wire axle being clamped between of a pair of resilient pads. Two or more different reflective surfaces may be provided so that different effects are available according to the surface selected to receive light; for example, shiny, diffused, colored, etc. The reflective surfaces may be formed in a convex or concave shape, as an alternative to a flat surface, to alter the divergence angle of the received light beam in addition to redirecting the beam. A two-sided mirror may be formed in two mating pieces in a spinning fabrication process.

16 Claims, 4 Drawing Sheets

10

LIGHT BEAM CONVERTER AND DEFLECTOR

FIELD OF THE INVENTION

The present invention relates to lighting fixtures and more particularly to improved means for directing illumination and controlling the divergence of beams from a lighting fixture through the use of novel forms and combinations of reflectors.

BACKGROUND OF THE INVENTION

Because many typical sources of light are small and intense, it has been common in the prior art to provide some means for diffusing, diverting, or otherwise softening or controlling the raw illumination from unobstructed sources. Means for achieving these results include such auxiliary devices as frosted globes for diffusion and a variety of reflecting devices. Further, adjustments to these auxiliary devices often are provided to achieve preferred or more satisfactory conditions of illumination in particular situations. Because many light sources also are hot, materials used in controlling illumination must be selected with due consideration for corrosion and for safety with respect to fire hazards.

RELATED PRIOR ART

In the extensive prior art that exists in this field, many disclosures have been made showing mirrors that deflect light beams in a variety of ways and from a variety of sources. Generally, this art restricts angular illumination from an otherwise essentially unimpeded field of light to achieve directional control that in some instances is adjustable. Also, in exchange for this angular restriction, a correspondingly greater intensity of illumination is achieved within the remaining angular field. Suspension hangers are disclosed in a variety of forms and purposes. Reflector shapes are disclosed with both flat and curved surfaces.

Some examples of pertinent prior art are as follows: Prall in U.S. Pat. No. 196,765 discloses a single surface reflector that is adjustable both angularly and rotatably but in a statically unbalanced fashion. Bliss in U.S. Pat. No. 529,105 discloses a longitudinally adjustable concave reflector. Hough and Weaver in U.S. Pat. No. 923,655 disclose a hinged flat reflector. Heile in U.S. Pat. No. 1,799,899 discloses a pair of flat reflectors with hinged adjustability. Colburn in U.S. Pat. No. 36,339 and Oeding in U.S. Pat. No. 51,344 disclose reflectors with pivotal adjustability. across the diameter of a circular reflector.

OBJECTS OF THE INVENTION

The present invention is directed to the easy augmentation of a conventional lighting fixture for use with applications involving accent illumination or wall wash illumination.

An object of this invention is to provide for a selection of lighting effects and adjustments to achieve a preferred type illumination.

A further object of this invention is to provide such selection of lighting effects in a simple and convenient manner.

SUMMARY OF THE INVENTION

The invention is a mountable combination light beam converter and deflector. The objects of this invention have been accomplished with a novel structure that consists of an assembled set of reflectors and a means for their rotational tilt adjustment in a statically balanced fashion resulting from circularly symmetrical construction. This rotational tilt adjustment allows both selection of an individual reflector from within the assembled set and fine positioning of the selected reflector. Further, a frictional means is provided so that any previously set rotational tilt adjustment is retained.

Positioning the selected reflector with respect to the light source in the lighting fixture produces many useful and desirable effects relating to the control and distribution of illumination. Such illumination effects include wall washing and lighting accents.

BRIEF DESCRIPTION OF THE DRAWINGS

The invention is fully disclosed in the following description and in the accompanying drawings in which.

DETAILED DESCRIPTION OF THE INVENTION

The present invention provides improved control over of otherwise conventional illumination emanating from a lighting fixture with respect to direction and divergence and with respect to whether reflection is specular or diffuse. Such control is achieved with a mountable beam deflector combination consisting of a plurality of reflectors having a variety of optical characteristics and that can be tilted or rotated to achieve many desired lighting effects. In a preferred embodiment of this invention two circular reflectors are employed, with each reflector being formed from a flat sheet of metal, preferably high purity aluminum, with one side finished to have the desired reflective surface, e.g. highly polished to a mirror surface; the outer edge of the reflector is formed in a conventional spinning fabrication process to have a suitably shaped edge lip by which two reflectors can be assembled together back-to-back. Such fabrication interlocking assembly can also be utilized to shape the initially flat circular reflecting surface into a curved shape, e.g. concave or convex. The use of metal provides a fire resistant device. The surface itself can also be treated to any type of polish, roughness, or applied film to achieve a great variety of optical effects.

Two reflectors can then be crimped together and interlocked by meshing the edge lips into the final assembly of two back-to-back reflectors. Typical preferred reflector diameters are four and six inches.

Provision is made for a wire suspension hanger element, a straight central portion of which is diametrically disposed and passes through the mirror assembly forming an axle to allow for rotation of the mirror assembly and for selecting rotational positions. Two matching friction pads internal to the mirror assembly engage the axle to provide drag for additional control over arbitrarily set rotational positions. An extension of the frame element is suitably formed to allow for attachment to the lighting fixture. A preferred configuration of the hanger element is formed from round wire suitably bent into the axle, supporting extensions, and hook elements.

Figure 1:
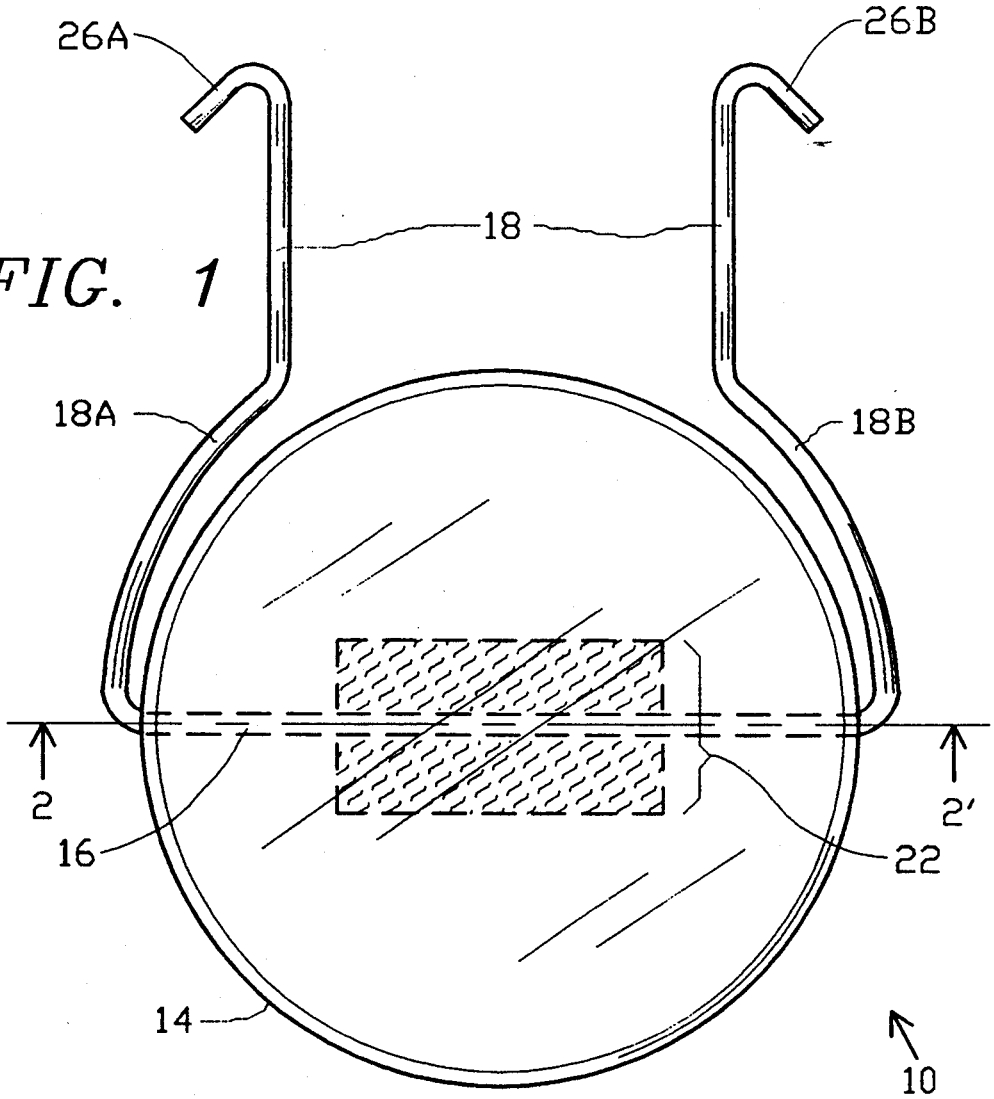
FIG. 1 is a front view of a mountable beam deflector combination including a mirror assembly, the wire suspension hanger element including a portion passing diametrically through the body of the assembly, and the associated friction pads.

FIG. 1 shows a front view of an embodiment of this invention. A mountable beam deflector combination 10 includes mirror assembly 14, friction pads 22, and a wire hanger element 18 consisting of straight diametrical axle 16, supporting extensions 18A and 18B, plus hook elements 26A and 26B. The hanger element 18 provides several functions. Axle 16 allows free rotation of mirror assembly 14 and also engages friction pads 22. The combined action of the friction pads and diametrical support of a mirror assembly produce two functions important for maintaining any rotational position of mirror assembly 14 once such a position has been set. Diametrical support of the symmetrically fabricated mirror assembly assures static balance without gravitationally induced torques. The friction pads add drag upon axle 16 to help maintain a previously set position. A preferred material for the friction pads is rubber.

Figure 2:
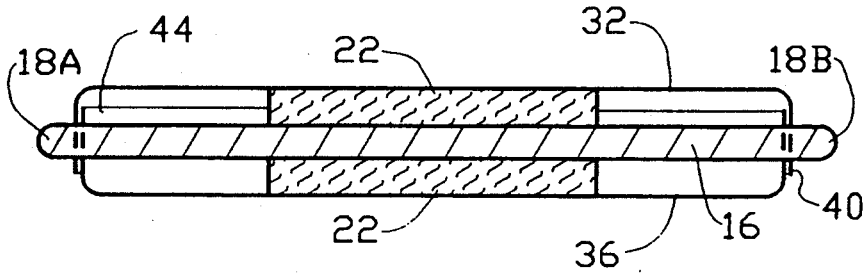
FIG. 2 is a cross sectional view of the mirror assembly of FIG. 1 taken through axis 2—2′ showing two interlocked reflective elements, the axle for rotation, and the associated friction pad.

FIG. 2 is a cross sectional view of mirror assembly 14 of FIG. 1 taken through axis 2—2' showing additional construction details. Two reflectors are formed from sheet material, typically formed in circular form using a spinning process. A first reflector 32 is made to have a reflective outer surface, and includes a peripheral edge lip 40 formed to be perpendicular to the reflective surface. Edge lip 40 is notched at appropriate diametrical locations to facilitate entry and support of axle 16.

Figure 2A:
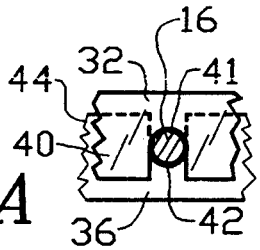
FIG. 2A is a partial end view of the subject of FIG. 2.
Figure 5:
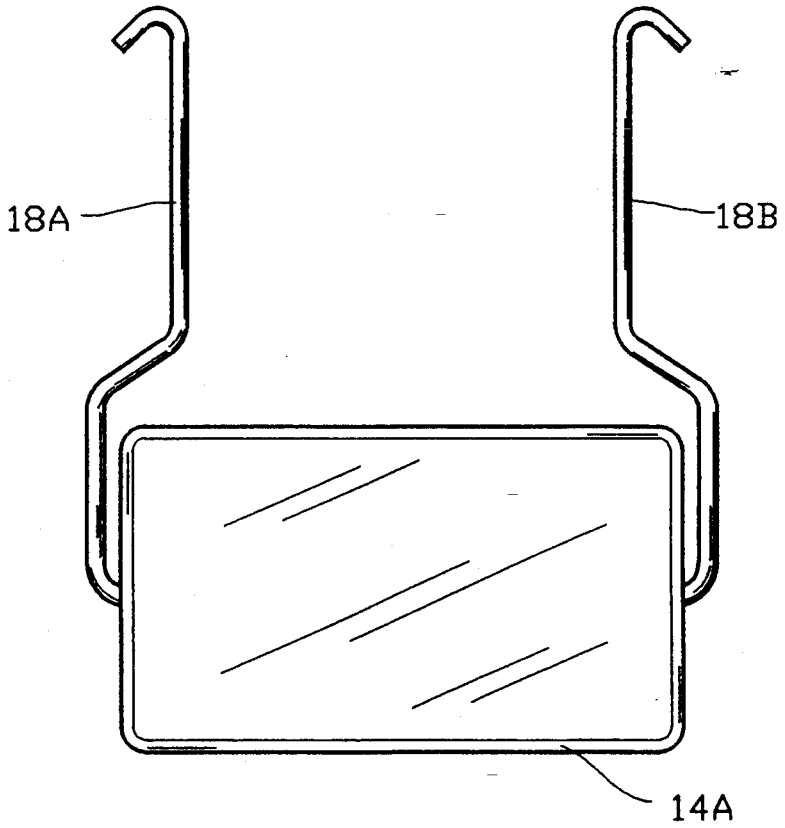
FIG. 5 is an elevational view showing a reflector of rectangular shape as an alternative to the round shape shown in FIGS. 1, 3 and 4.
Figure 2B:
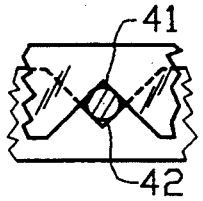
FIG. 2B is a partial end view of the subject of FIG. 2 showing V-shaped notches as an alternative to the U-shaped notches shown in FIG. 2A.

A second reflector 36, similarly formed and also made to have a reflective outer surface, is suitably notched to match the notches in edge lip 40. The notches 41 and 42 may be either U-shaped as shown in the detailed side view FIG. 2A or V-shaped as shown in the detailed side view FIG. 2B, to accommodate a circular axle. The first reflector 32 is formed with a slightly larger diameter than the second reflector 36 so that the two reflectors are capable of being interlocked as the two edge lips slip together to form the overall mirror assembly 14. Friction pad 22 must be in place before final assembly. As the reflectors are interlocked, axle 16 is clamped within the matching notches for support of the mirror assembly and to form effectively two rotational bearings.

Sheet metal is a preferred material. A spinning forming process is preferred. Circularly symmetrical reflectors are preferred. Many other materials, mirror shapes, and fabrication techniques are feasible and are consistent with the concept and spirit of this invention.

Figure 3:
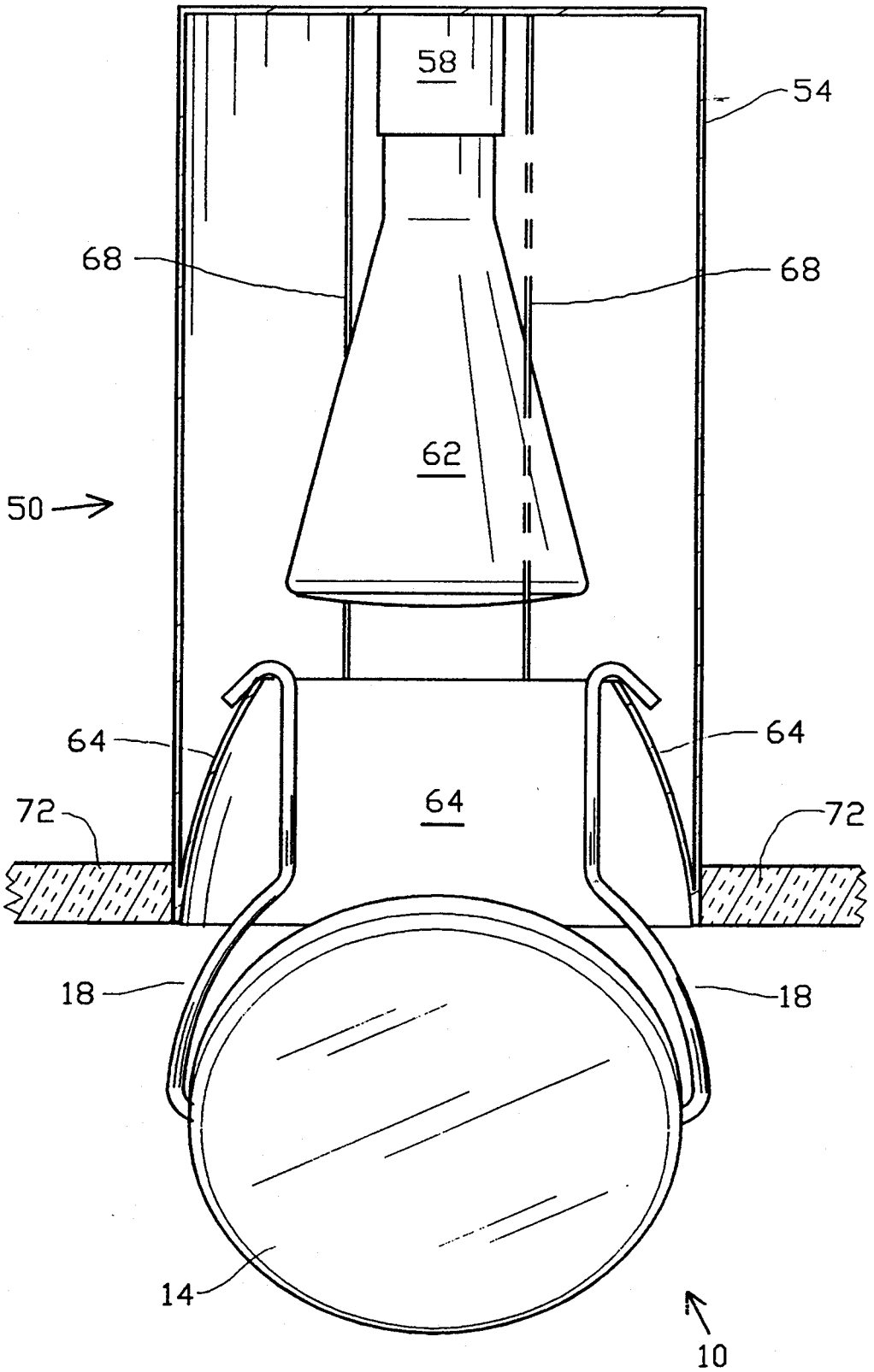
FIG. 3 shows a complete mountable beam deflector combination installed into a lighting fixture having a shallow cone.

FIG. 3 shows the mountable beam deflector combination 10, shown previously in FIG. 1, installed in a lighting fixture 50 with shallow internal cone 64, fixture 50 being recessed into a ceiling 72 as shown. A shallow cone is defined as one upon which hanger element 18 is long enough for hook elements 26A and 26B to fit over the upper edge of cone 64 to provide support for the mountable beam deflector combination 10. This arrangement provides vertical support and allows mountable beam deflector combination 10 to be rotated around a vertical axis. Features of lighting fixture 50 include outer cylinder 54, lighting cone supports 68, and lamp socket 58, holding lamp 62 in a downwardly-facing disposition as shown. Fixture 50 is shown as being mounted flush with ceiling 72. Mirror assembly 14 is shown partially tilted around its horizontal axis.

Figure 4:
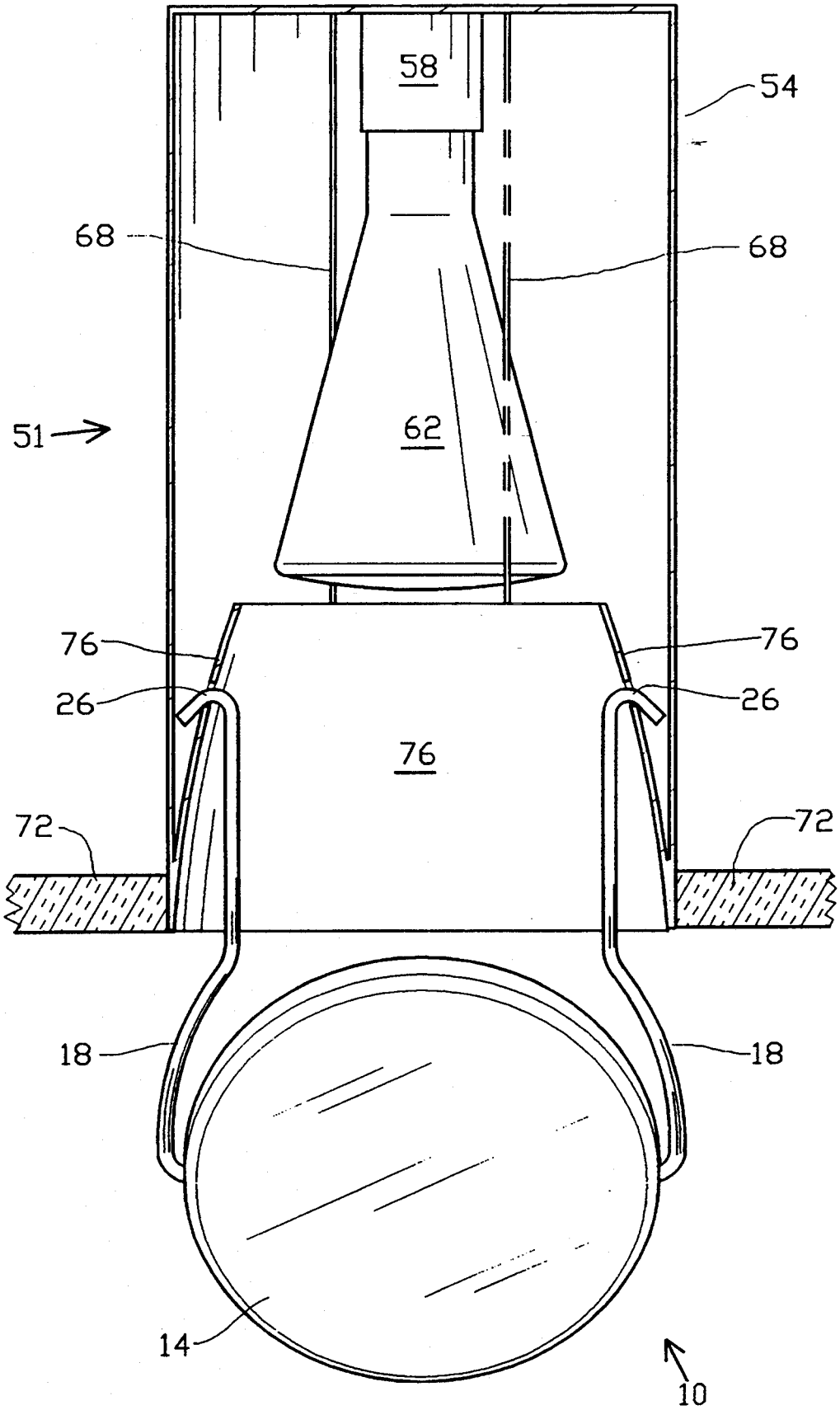
FIG. 4 shows a complete mountable beam deflector combination installed into a lighting fixture having a deep cone.

FIG. 4 shows mountable beam deflector combination 10 installed in lighting fixture 51 with a deep internal cone 76. A deep cone is defined as one that is too long for hook elements 26 to reach its upper edge. As a result, suitable mounting holes or other means must be formed in cone 76 to provide vertical support for mountable beam deflector combination 10. In other respects FIGS. 3 and 4 are the same.

Reflecting surfaces 32 and 36 in FIG. 2 can be formed to produce a variety of illumination effects. They can be convex, flat, or concave for any desired divergence of illumination. They can be treated with any color. All or any portion of their surfaces can be treated with appropriate polish or roughness to provide for either specular or diffuse reflection. In the preferred embodiment, selection of any two of such features can be made readily in a particular mountable beam deflector combination. As a result, the versatility and utility of this invention is substantial with respect to control of illumination from a lighting fixture.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A light deflector comprising in combination:

a manually tiltable reflecting assembly comprising a pair of mirrors disposed back-to-back so as to provide a pair of opposed outwardly-facing reflecting surfaces;

hanger means, for suspending said reflecting assembly from a light fixture, comprising a pair of hook elements disposed at an upper end thereof, a straight central axle portion passing through said reflecting assembly, and a connecting portion joining the hook elements to the axle portion; and friction means, for retaining said assembly at a previous setting of tilt, comprising a matching pair of compliant pads each secured to a corresponding inwardly-facing rear surface of a respective one of said mirrors, said pads compressively bearing on said axle against opposite sides thereof.

2. The light deflector as defined in claim 1 wherein the mirrors in said reflecting assembly are made circular in form.

3. The light deflector as defined in claim 2 wherein said hanger means is formed from a bent wire configuration.

4. The light deflector as defined in claim 2 wherein each of said circular mirrors is configured to have an edge lip in ring form disposed essentially perpendicular to the reflecting surface of the mirror.

5. The light deflector as defined in claim 4 wherein the edge lips are configured with notches, at diametrical locations, engaging the axle portion of said hanger means.

6. The light deflector as defined in claim 5 wherein the said notches are made U-shaped.

7. The light deflector as defined in claim 5 wherein the said notches are made V-shaped.

8. The light deflector as defined in claim 4 comprising a first and a second reflector, the edge lip of the first reflector being made larger than the edge lip of the second reflector so as to enable the edge lips to interlock together in an overlapping manner.

9. The light deflector as defined in claim 2 wherein at least one of said reflecting surfaces is made flat.

10. The light deflector as defined in claim 2 wherein at least one of said reflecting surfaces is made concave.

11. The light deflector as defined in claim 2 wherein at least one of said reflecting surfaces is made convex.

12. The light deflector as defined in claim 2 wherein at least one of said reflecting surface is made specular.

13. The light deflector as defined in claim 2 wherein at least a portion of each of said reflecting surfaces is roughened for diffuse reflection.

14. The light deflector as defined in claim 3 wherein said reflecting surfaces and said edge lips are formed from metal.

15. The light deflector as defined in claim 14 wherein the reflecting surfaces and the edge lips are formed with a spinning process.

16. The light deflector as defined in claim 1 wherein said reflecting surfaces are made rectangular in form.

* * * * *